United States Patent [19]

Plischke

[11] 3,965,787

[45] June 29, 1976

[54] RETRACTABLE BLADE GUARD

[76] Inventor: Eugene W. Plischke, 99-549 Pohue Place, Aiea, Hawaii 96701

[22] Filed: Dec. 15, 1975

[21] Appl. No.: 640,850

[52] U.S. Cl. ..... 83/478; 83/544

[51] Int. Cl.[2] ..... B27G 19/04

[58] Field of Search ..... 83/478, 544, 398

[56] References Cited

UNITED STATES PATENTS 3,913,437 10/1975 Speer et al. ..... 83/478

*Primary Examiner*—Willie G. Abercrombie

*Attorney, Agent, or Firm*—George W. T. Loo

[57] ABSTRACT

A retractable blade guard which protects the operator from the blade of a rotary saw or other cutters. The guard includes two moveable cam-action guard sections of similar design mounted on the opposite ends of a conventional hood guard. Each section includes an obverse leaf rigidly connected to a reverse leaf by a rod and a guard extension. Each guard section moves independently of the other. The guard section rides up, onto and on top of, and down over the fence or the stock as it is being cut in either direction during cross-cutting, mitering or ripping, yet provides optimal coverage of the blade in the cutting zone.

10 Claims, 11 Drawing Figures

RETRACTABLE BLADE GUARD

BACK GROUND OF THE INVENTION

1. Field of the Invention

This invention relates to a retractable blade guard for power driven rotary saws or other cutters.

2. Description of the Prior Art

Prior art retractable blade guards, such as Kaley, U.S. Pat. No. 2,926,709, dated Mar. 1, 1960, do not protect the operator at all times from the cutting member and moving parts of power driven rotary saws or other cutters due to to their configurations and designs. Moreover, they must be specially fabricated for each make and model. In addition, they do not comply with Standard 01.1 of the American National Standards Institute, Inc., and with S1910.213 of the Occupational Safe and Health Act of 1970 (OSHA).

SUMMARY OF THE INVENTION

This invention relates to a retractable blade guard for power driven rotary saws or other cutters which automatically adjusts itself to the thickness of, and remains in contact with the stock being cut or with the table or fence to give maximum operator protection regardless of the cutting operation. It guards the lower exposed cutting portions below the conventional hood guard of machines having power driven rotary saw blades or other cutters.

An object of this invention is to provide a retractable blade guard for power driven rotary saws or other cutters which automatically adjust in all cutting operations to give maximum operator protection from the cutting edge of the blade.

Another object of this invention is to provide a retractable blade guard for power driven rotary saws or other cutters which is simple and easy to operate and to maintain.

Still another object of this invention is to provide a retractable blade guard for power driven rotary saws or other cutters which requires a minimum number of movable parts.

Yet another object of this invention is to provide a retractable blade guard for power driven rotary saws or other cutters which meet American National Standards Institute, Inc., standards and OSHA requirements.

A further object of this invention is to provide a retractable blade guard for power driven rotary saws or other cutters with improved visibility in the cutting area, while maintaining maximum protection, when necessary to perform functions such as aligning the stock for a precision cut.

Another object of this invention is to provide a retractable blade guard for power driven rotary saws or other cutters which is easy to install on existing machine makes and models.

Still another object of this invention is to provide a retractable blade guard for power driven rotary saws or other cutters which provides for more complete guarding of the exposed teeth at all times with all sizes of lumber and does not impose any limitation on possible depth of cuts less than that which any machine can do without a guard in place.

Yet another object of this invention is to provide a retractable blade guard for power driven rotary saws or other cutters which is mounted externally of the hood guard to facilitate cleaning and to avoid accumulation of dust and debris that may cause malfunction.

A further object of this invention is to provide a retractable blade guard for power driven rotary saws or other cutters which need not be specially fabricated for each make and model.

Another object of this invention is to provide a retractable blade guard for power driven rotary saws or other cutters which rides up, over and down as stock is cut to give maximum operator protection from the cutting edge of the blade.

Still another object of this invention is to provide a retractable blade guard for power driven rotary saws or other cutters which will not expose the cutting zone when a hand is moved against the guard.

Other objects, features and advantages of the present invention will be readily apparent from the following detailed description.

DESCRIPTION OF THE PREFERRED EMBODIMENTS

Figure 1:
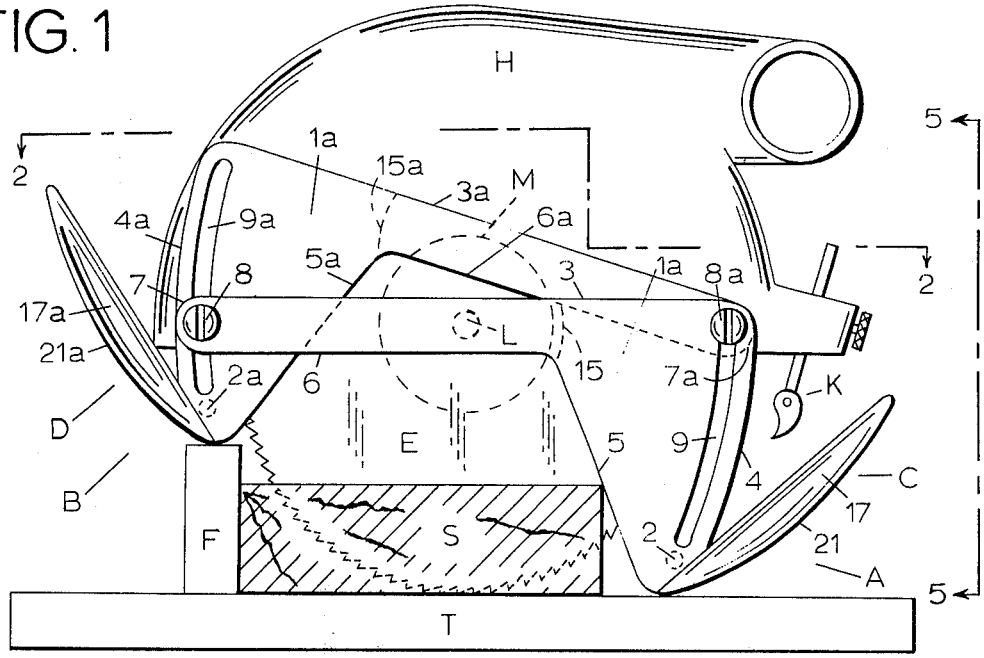
FIG. 1 is a front view of my invention mounted on a conventional hood guard of a power driven rotary saw with one guard section on top of a fence and the other guard section in contact with the stock being cut.
Figure 2:
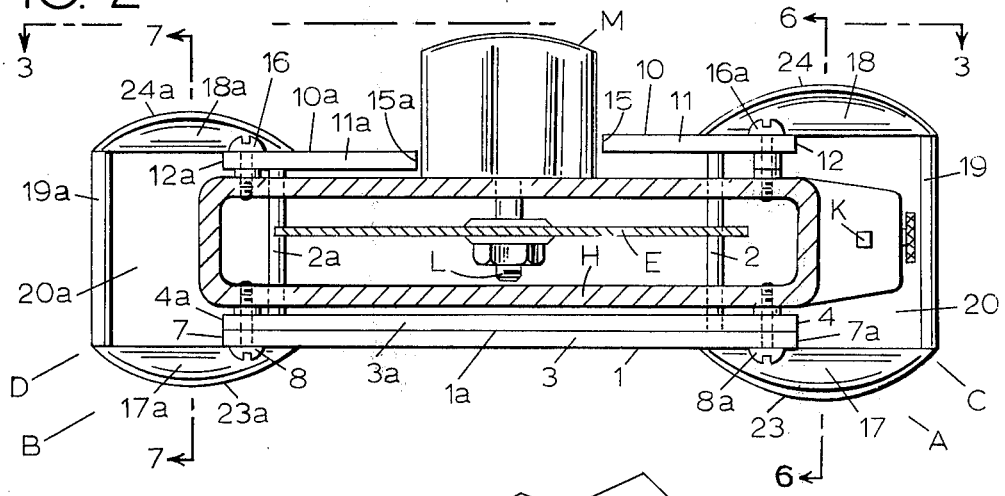
FIG. 2 is a top view of the invention taken on line 2—2 of FIG. 1 with the hood guard and blade in section.
Figure 3:
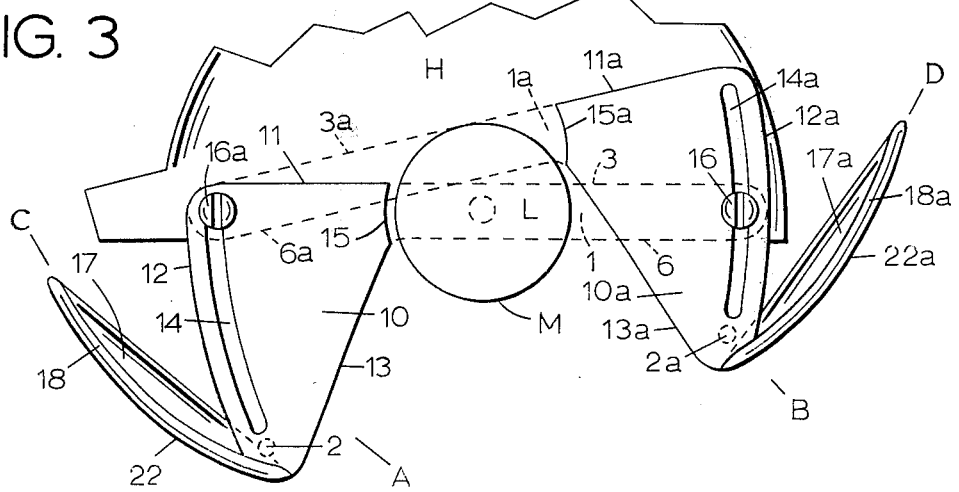
FIG. 3 is a rear view of the invention taken on line 3—3 of FIG. 2.
Figure 4:
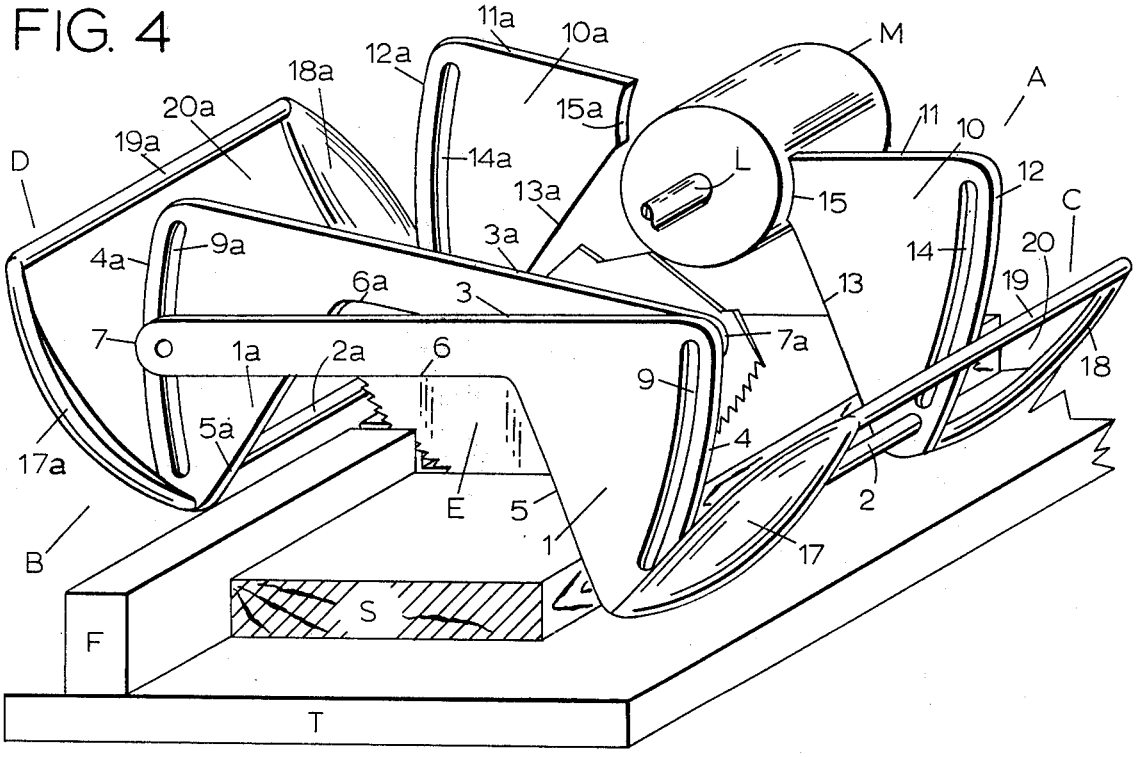
FIG. 4 is a perspective of the invention.
Figure 5:
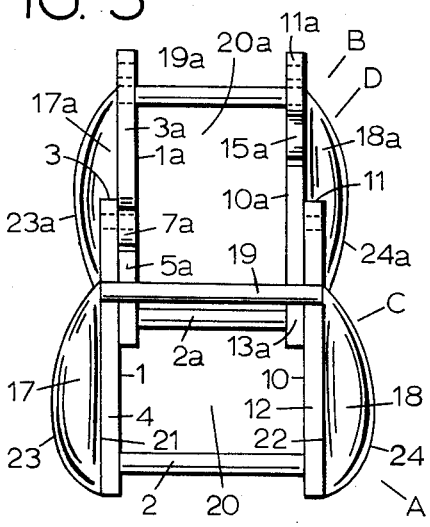
FIG. 5 is an end view of the invention taken from line 5—5 of FIG. 1.
Figure 6:
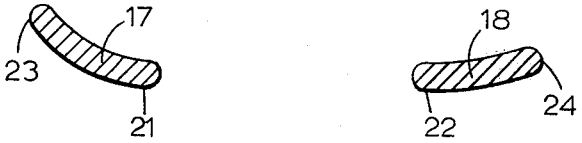
FIG. 6 is an enlarged fragmentary sectional view taken on line 6—6 of FIG. 2 to show the curvature of the side members of extension C.
Figure 7:
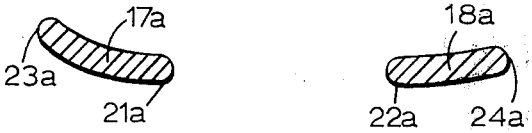
FIG. 7 is an enlarged fragmentary sectional view taken on line 7—7 of FIG. 2 to show the curvature of the side member of extension D.

Before explaining the present invention in detail, it is to be understood that the invention is not limited in its application as described herein since the invention is capable of other embodiments and of being practiced or carried out in various ways. Also, it is to be understood that the phraseology or terminology employed herein is for the purpose of description and not of limitation.

Referring now to the drawings wherein like reference numerals refer to like and corresponding parts throughout the several views, the preferred embodiment of the invention disclosed in FIGS. 1 to 8 inclusive includes two guard sections A and B which are pivotally mounted on the opposite ends of a conventional hood guard H. Sections A and B are mirror images of each other except that section B is narrower than section A, so that it may move within the planes formed by the leaves of section A. Each section moves independently of the other. (See FIGS. 1, 2 and 4).

Section A includes an obverse leaf 1, a rod 2, a reverse leaf 10, and an extension C. Obverse leaf 1 is rigidly connected to reverse leaf 10 in the vicinity of their lowest contact points by rod 2 and extension C. (See FIGS. 1 and 4).

Section B includes an obverse leaf 1*a*, a rod 2*a*, a reverse leaf 10*a*, and an extension D. Obverse leaf 1*a* is rigidly connected to reverse leaf 10*a* in the vicinity of their lowest contact points by rod 2*a* and extension D. (See FIGS. 1 and 4).

Obverse leaf 1 has a top edge 3, an outer edge 4, a cam edge 5, a bottom edge 6, an inner edge 7, and an arcuate slot 9. Obverse leaf 1*a* is similarly shaped with the equivalent parts designated by the same reference numerals and the letter *a*. (See FIGS. 1 and 4).

Reverse leaf 10 has a top edge 11, an outer edge 12, a cam edge 13, an arcuate slot 14, and an inner edge 15. Reverse leaf 10*a* is similarly shaped with the equivalent parts designated by the same reference numerals and the letter *a*. Reverse leaves 10 and 10*a* are similar to obverse leaves 1 and 1*a* except that they are shortened to clear motor M. (See FIGS. 2, 3 and 4).

Extension C includes an obverse side member 17, a reverse side member 18, and a cross member 19. Obverse side member 17 is connected at one end to cross member 19 and at the other end to obverse leaf 1. Reverse side member 18 is connected at one end to cross member 19 and at the other end to reverse leaf 10. (See FIG. 4).

Obverse side member 17 is semi-spoon shaped while reverse side member 18 is only slightly so curved. Bottom cam edges 21 and 22 on obverse side member 17 and reverse side member 18, respectively, continue the curvature of cam edges 5 and 13, respectively, to facilitate the raising of the extension upon a fence F or a stock S. (See FIGS. 4 and 6).

The curvature of outer cam edge 23 facilitates the raising of extension C when the machine head is tilted for the maximum 45° bevel cut. The spoon-shaped surface between bottom cam edge 21 and outer cam edge 23 facilitates the raising of the extension for bevel cuts between 0° and 45°. (See FIG. 6).

Outer edge 24 of reverse side member 18 is curved essentially to avoid binding against the fence F or the stock S. The bottom curvature of the side members 17 and 18 provide minimal contact of the extension to reduce marring of the stock S. (See FIGS. 4 to 6).

Extension D is similar to extension C except for its width as explained above. The equivalent parts of extension D are designated by the same reference numerals and the letter *a*. (See FIGS. 4, 5 and 7).

Opening 20 is needed to allow the use of conventional anti-kickback device k during ripping operations. Opening 20 in extension C and opening 20*a* in extension D provide better visibility of the cutting zone to allow alignment of blade E with the cut to be made in stock S. (See FIGS. 1 and 2). If better visibility of the cutting zone is not required, the extension may be made of solid construction and an opening provided to permit the use of an anti-kickback device K.

Sections A and B are pivotally mounted to the opposite ends of hood guard H by means of pivots 8, 8*a*, 16 and 16*a*. Pivot 8*a* engages arcuate slot 9; pivot 8 engages arcuate slot 9*a*; pivot 16*a* engages arcuate slot 14; and pivot 16 engages arcuate slot 14*a*. The pivots and their corresponding slots limit the upper and lower travel of the leaves. (See FIGS. 1–3).

Obverse leaf 1 rotates about pivot 8. It is freely pivotable up to the degree permitted by slot 9 and pivot 8*a*. Obverse leaf 1*a* rotates about pivot 8*a*. It is freely pivotable up to the degree permitted by slot 9*a* and pivot 8. (See FIG. 1).

Pivot 16 and 16*a* serve to engage reverse leaves 10*a* and 10, respectively, along the arcuate slots 14*a* and 14 respectively. Reverse leaf 10 is movable up to the degree permitted by slot 14 and pivot 16*a*. Reverse leaf 10*a* is movable up to the degree permitted by slot 14*a* and pivot 16. Pivot 16 and 16*a* keep leaves 10 and 10*a* in alignment with hood guard H and slots 14 and 14*a*. (See FIGS. 2 and 3).

Pivots 8, 8*a*, 16 and 16*a* are essentially in line with arbor L and are horizontally aligned. (See FIGS. 1 and 3). The pivots may be threaded screws or bolts received through bosses in the hood guard H. Spacers, washers and retainers are used as needed for fitting and securing the leaves, yet allowing their free movement about the axes at the pivots.

In place of the pivots as described, a throughbolt type of pivot may be used to retrofit machines where the hood guards may not have the proper bosses or an auxiliary mounting bracket may be affixed to the hood guard to accept the mounting of my invention.

The pivots are located beyond the circumference of saw blade E. With the pivots away from the arbor L, the outer edges 4, 4*a*, 12 and 12*a* will maintain the greatest protective distance beyond the periphery of blade E and very little force is required to cause the rotation of guard sections A and B about their respective pivots. (See FIGS. 1 and 2).

With each guard section pivotally mounted as described, it is apparent that within the limits of travel imposed by the arcuate slots, the leaves at all times extend beyond the blade diameter for maximum protection from the cutting zone.

The cam edges 5, 5*a*, 13 and 13*a* are shaped to facilitate and maximize the rise of the leaves, yet allow the leaves to promptly drop over fence F or stock S being cut to maximize operator protection from the exposed blade E. The cam edges 5, 5*a*, 13 and 13*a* should be as nearly vertical as possible and still achieve cam action. The object is to have the leaves drop as soon as possible and as close to the table T or stock S being cut as possible.

Top edges 3, 3*a*, 11 and 11*a* should be nearly horizontal and be no higher than necessary about the horizontal line of the pivots in order to present as low a profile as possible when sections A and B are in their highest raised positions. Outer edges 4, 4*a*, 12 and 12*a* should not extend too far beyond the pivots. Bottom edges 6 and 6*a* should be as nearly horizontal and as high as possible above the point of contact of the leaves with table T when in the neutral position.

Extensions C and D allow the guard sections A and B to rise on top of the thickest stock to be cut; provide cam action to facilitate the raising and falling movements of sections A and B upon the fence or the stock; provide additional guarding in the plane of the blade and between the planes of the leaves to increase the protection farther from the cutting zone; permit safe manual lifting or adjustment of the sections if needed; and provide rigidity to the joining of obverse leaves to reverse leaves, additional to that provided by rods 2 and 2*a*.

Figure 8:
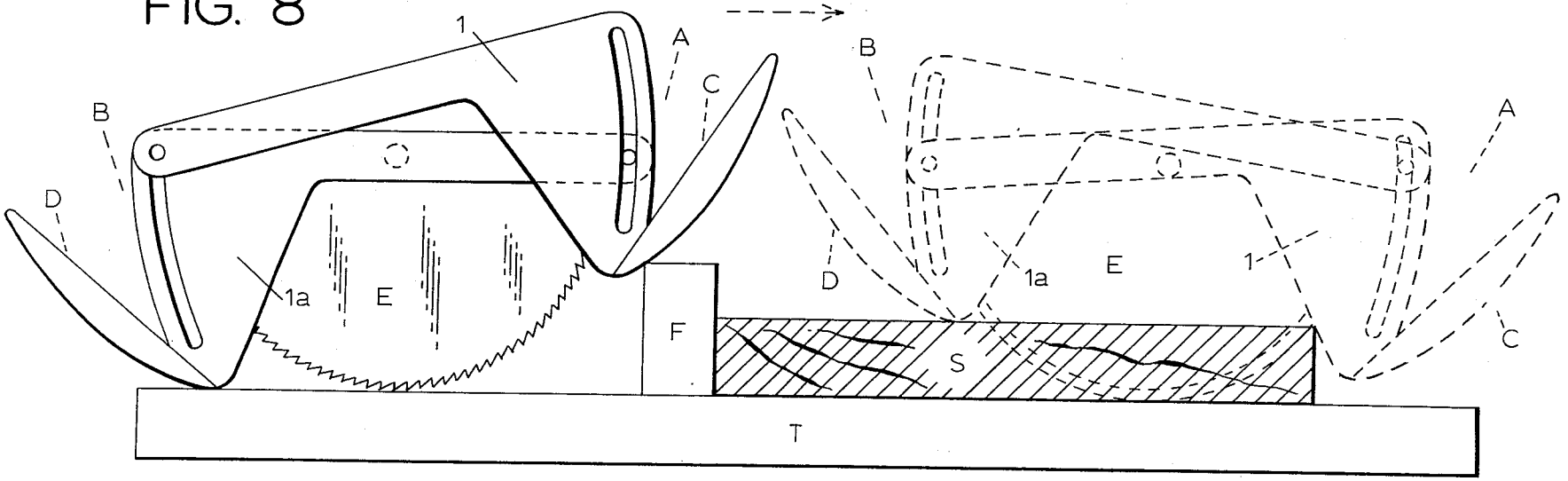
FIG. 8 is a front view of the invention showing the movements of the guard sections in cross-cutting operation.

FIG. 8 shows the movements of guard sections A and B in a cross-cutting operation. Section A is the leading section and section B is the trailing section. The cutting tool E is moved from the full line position through stock S to the dotted line position. Referring to the full line position it will be seen that section A has been cammed upwardly by cam edges 21 and 23 contacting fence F. As the saw carriage is moved forward in the direction of the dotted arrow to the dotted line position, section A drops downwardly toward stock S until the lowest point of section A contacts and then remains in contact with stock S to give maximum operator protection. When section A passes stock S, it drops downwardly until the lowest point of section A contacts table T. Section B is cammed upwardly by the cam edges 5*a* and 13*a* contacting fence F. Then it drops downwardly toward stock S until its lowest point contacts stock S. The trailing edge of the cutting tool above stock S is entirely guarded by section B.

As the saw carriage is returned to the solid line position from the dotted line position, section B will clear fence F and then drop downwardly toward table T until its lowest point contacts table T. Section A will be cammed upwardly by cam edges 5 and 13 upon contacting fence F. Then it is cammed downwardly by cam edges 21 and 22 to the position shown.

In a ripping operation the saw carriage is rotated ninety degrees and locked in a stationary position so that the cutting tool E rotates in a plane parallel to fence F. Section B becomes the leading section and section A becomes the trailing section. Stock S is moved past the cutting tool E. Sections A and B automatically adjust themselves to the thickness of stock S and remain in contact with stock S to give maximum protection possible for the operation being performed. The cutting tool E is covered or guarded by both sections.

Figure 9:
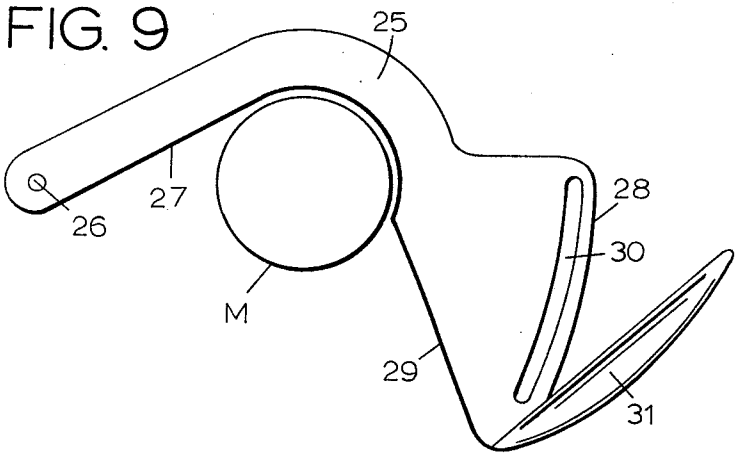
FIG. 9 is a front view of a modified leaf with an extension.

FIG. 9 shows a modified leaf which may be used as an obverse leaf and/or reverse leaf for retrofitting some existing hood guard designs or for an alternate where possible on some machines. An arcuate arm 25 extends from pivot 26 with bottom edge 27 clearing the motor M to connect to the essential guard face having an outer edge 28, a cam edge 29, and arcuate slot 30, identical to leaf designs previously described. Extension 31 is identical to that previously described for extensions C and D.

Figure 10:
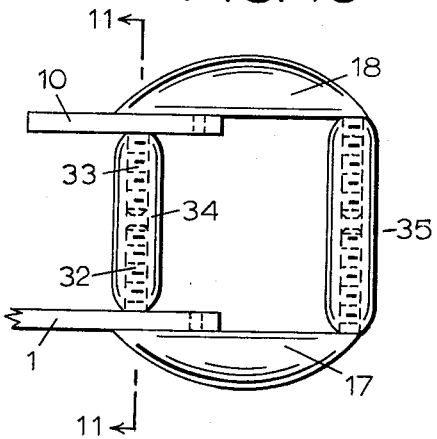
FIG. 10 is a fragmentary top view of a guard section showing a modified rod and cross member having a turnbuckle design.
Figure 11:
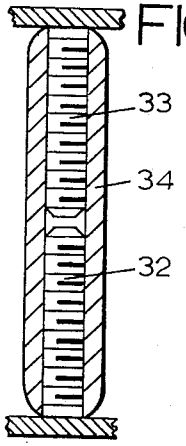
FIG. 11 is a fragmentary sectional view taken on line 11—11 of FIG. 10 to show the turnbuckle design.

FIG. 10 shows a modified rod and a modified cross member utilizing a turnbuckle design to provide a convenient adjustment and assembly in fitting moveable guard sections A and B to hood guards of varying thickness. Threaded rod 32 is rigidly connected to obverse leaf 1 in line with a comparable threaded rod 33, which is rigidly connected to reverse leaf 10. A sleeve 34 is internally threaded to match the threads of rods 32 and 33 so as to function as a turnbuckle. Cross member 34 is similarly designed. FIG. 11 shows the turnbuckle design of the rod.

My invention guards the lower exposed cutting portions below the conventional hood guard of power driven saws or other cutters.

My invention permits each of two moveable cam-action guard sections of similar design, mounted on opposite ends of a hood guard to independently rise and fall and automatically ride up, onto and on top of, and down over the fence or the stock as it is being cut in either direction during cross-cutting, mitering or ripping, yet maintaining optimal coverage of the saw teeth in the cutting zone.

My invention will rise on top of the fence when the saw is returned to the back of the table. My invention will drop on top of and remain in contact with the table or stock being cut. My invention is in accord with Standard 01.1 of the American National Standards Institute, Inc., and with S1910.213 of the Occupational Safety and Health Act of 1970.

Manufacture of my invention may be achieved by any of the commonly available fabrication methods, e.g., stamping, cutting, molding or forming from hot or cold metal or plastic or similar materials, perforated or not, transparent or not, with pivot holes and slots drilled, cut or formed in the leaves for mounting by use of common fasteners. The extensions may be formed in one piece along with the leaves as a module or fabricated separately and joined by any suitable and commonly available means.

Retractable blade guards of different sizes may be necessary to fit machines of different makes or models. Minor mounting modifications are to be expected. Models not accepting attachment directly to the hood guard may require an auxiliary mounting device secured to the saw head or the hood guard before my invention may be affixed.

If it is deemed desirable, either of the two sections may be used without the other. For example, using existing guard systems at the rear of the cutting table would obviate the need of the trailing section in the cutoff mode.

Although but three embodiments of the invention have been disclosed and described herein, it is obvious that many changes may be made in the size, shape, arrangement, and detail of the various elements of the invention without departing from the scope of the novel concepts of the present invention.

I claim as my invention:

1. A retractable blade guard for use as a lower safety guard of a rotary power cutting tool comprising a guard section and securing means for pivotally mounting the guard section on the hood guard of said cutting tool; the guard section has an obverse leaf, a reverse leaf, a rod and an extension; the obverse leaf is rigidly connected to the reverse leaf in the vicinity of their lowest contact points by the rod and the extension; the guard section is arranged to pivot about an axis which is located beyond the circumference of the cutting tool; the guard section is arranged to shield a portion of the arc of travel of said cutting tool; and the guard section is arranged to automatically adjust itself to the thickness of a stock being cut and remain in contact with the stock being cut to give maximum protection possible during the operation of said cutting tool.

2. A retractable blade guard of claim 1, wherein the obverse leaf has a top edge, an outer edge, a cam edge, a bottom edge, an inner edge, and an arcuate slot; reverse leaf has a top edge, an outer edge, a cam edge, an arcuate slot, and an inner edge; reverse leaf is similar to obverse leaf except that it is shortened to clear the motor of the cutting tool.

3. A retractable blade guard of claim 2, wherein the extension includes an obverse side member, a reverse side member, and a cross member; the obverse side member is connected at one end to the cross member and at the other end to the obverse leaf; the reverse side member is connected at one end to the cross member and at the other end to the reverse leaf; the obverse side member is semispoon shaped while the reverse side member is only slightly so curved; bottom cam edges on the obverse side member and the reverse side member continue the curvature of the cam edges of the obverse leaf and the reverse leaf, respectively, to facilitate the raising of the extension upon a fence or a stock being cut.

4. A retractable blade guard of claim 3, wherein the securing means engage the arcuate slot to limit the upper and lower travel of the leaves.

5. A retractable blade guard of claim 1, wherein there are two guard sections in opposite relation to each other; the guard sections are mirror images of each other except that one guard section is made narrower than the other so that it may move within the planes formed by the leaves of the other; and each guard section moves independently of the other.

6. A retractable blade guard of claim 4, wherein there are two guard sections in opposite relation to each other; the guard sections are mirror images of each other except that one guard section is made narrower than the other so that it may move within the planes formed by the leaves of the other; and each guard section moves independently of the other.

7. A retractable blade guard of claim 5, wherein the extensions provide additional guarding in the plane of the cutting tool and between the planes of the leaves to increase the protection farther from the cutting zone and provide an opening to permit the use of an anti-kickback device.

8. A retractable blade guard of claim 3, wherein the rod and cross member of the extension are of a turnbuckle design.

9. A retractable blade guard of claim 1, wherein the obverse leaf has a top edge, an outer edge, a cam edge, a bottom edge, an inner edge, and an arcuate slot; reverse leaf has an arcuate arm, a bottom edge, an outer edge 28, a cam edge and an arcuate slot; the bottom edge of the reverse leaf is designed to clear the motor of the cutting tool.

10. A retractable blade guard of claim 9, wherein the securing means engage the arcuate slots to limit the upper and lower travel of the leaves.

* * * * *